US005152428A

United States Patent [19]

Di Gerolamo

[11] Patent Number: 5,152,428

[45] Date of Patent: Oct. 6, 1992

[54] TANK WITH CONNECTING UNION AND A CUTTING BLADE

[76] Inventor: Silvestro Di Gerolamo, Viale Lucania, 13, 20139 Milano, Italy

[21] Appl. No.: 631,323

[22] Filed: Dec. 20, 1990

[30] Foreign Application Priority Data

Dec. 22, 1989 [IT] Italy ..... 22829 A/89

[51] Int. Cl.[5] ..... B67D 5/00

[52] U.S. Cl. ..... 222/80; 222/325; 141/329; 141/364

[58] Field of Search ..... 222/80, 85, 87, 147, 222/153, 562, 325; 215/14, 30, 252; 220/86.4; 141/329, 364

[56] References Cited

U.S. PATENT DOCUMENTS

| | | | |
|---|---|---|---|
| 2,822,964 | 2/1958 | Shore | 222/562 X |
| 3,118,288 | 1/1964 | Small | 222/85 X |
| 3,529,750 | 9/1970 | Baumann et al. | 222/153 X |
| 4,047,641 | 9/1977 | Delaney | 222/80 |
| 5,007,545 | 4/1991 | Imbery, Jr. | 222/147 X |

FOREIGN PATENT DOCUMENTS

| | | | |
|---|---|---|---|
| 2228055 | 8/1990 | United Kingdom | 222/147 |

*Primary Examiner*—Kevin P. Shaver
*Assistant Examiner*—Kenneth DeRosa
*Attorney, Agent, or Firm*—Shlesinger, Fitzsimmons, Shlesinger

[57] ABSTRACT

A tank of soluble powdered compound for the preparation of beverages comprising a container (10) the mouth of which is connected to a union (11) for supply of the compound to an automatic beverage preparation and dispensing machine, said container comprising near its mouth a circumferential shoulder (17) in complementary engagement with the union. The engagement is irreversible, and the shoulder itself is breakable from the container by engagement with a blade (15) in the union (11) upon rotation of the container (10) therein so as to permit separation of the container (10) from the union (11).

8 Claims, 3 Drawing Sheets

Figure 1:
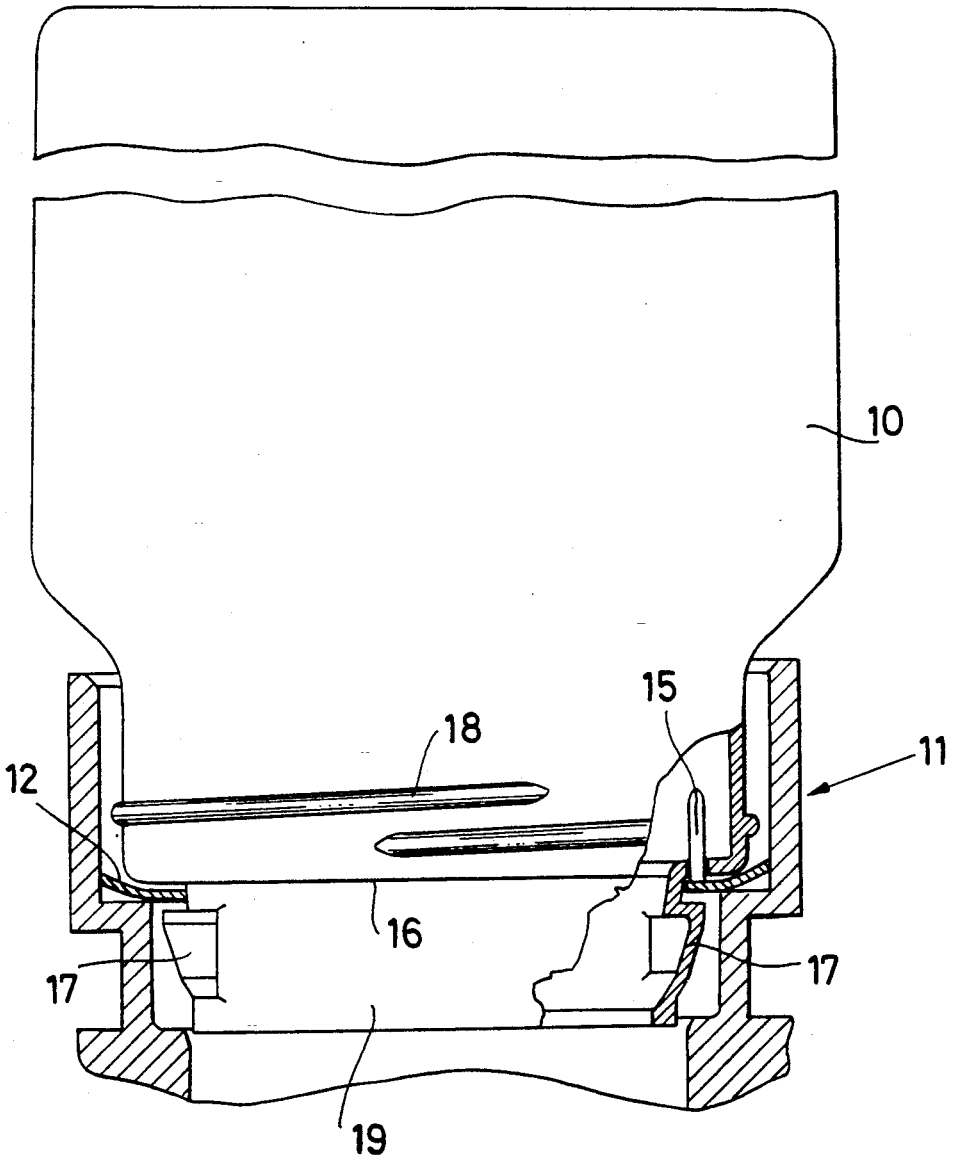

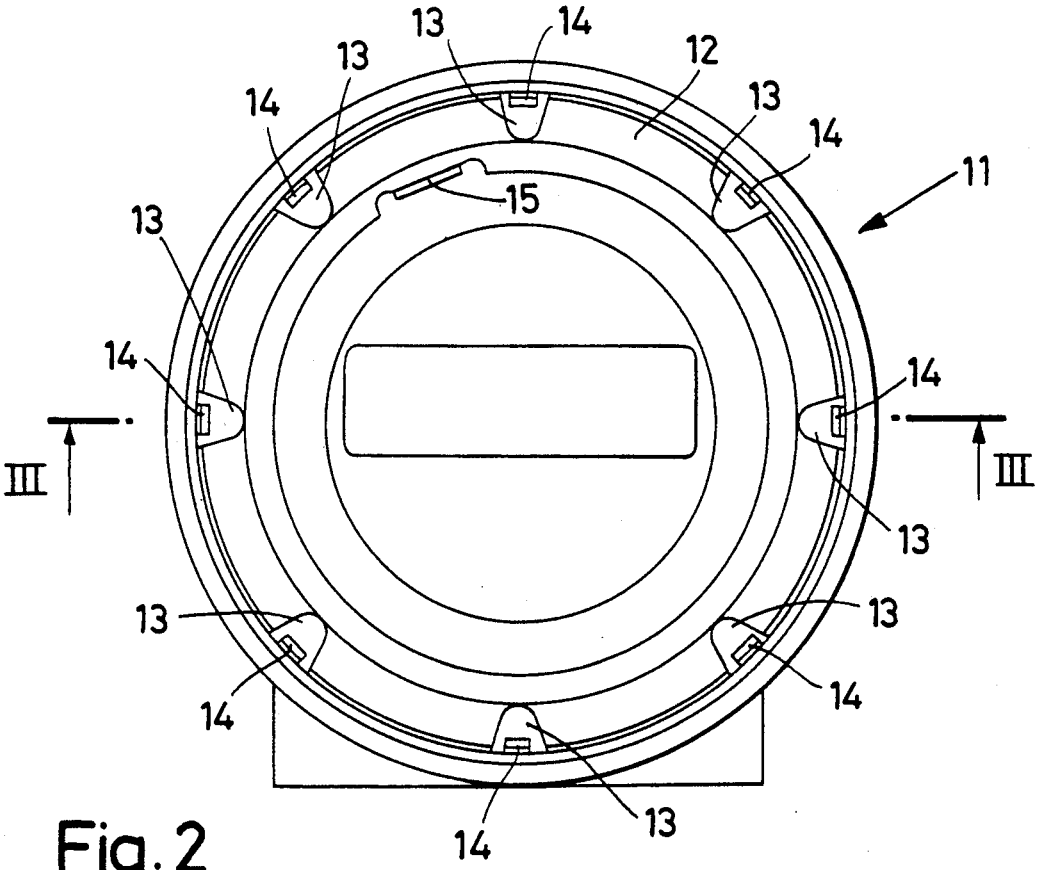
Fig. 2
Fig. 3
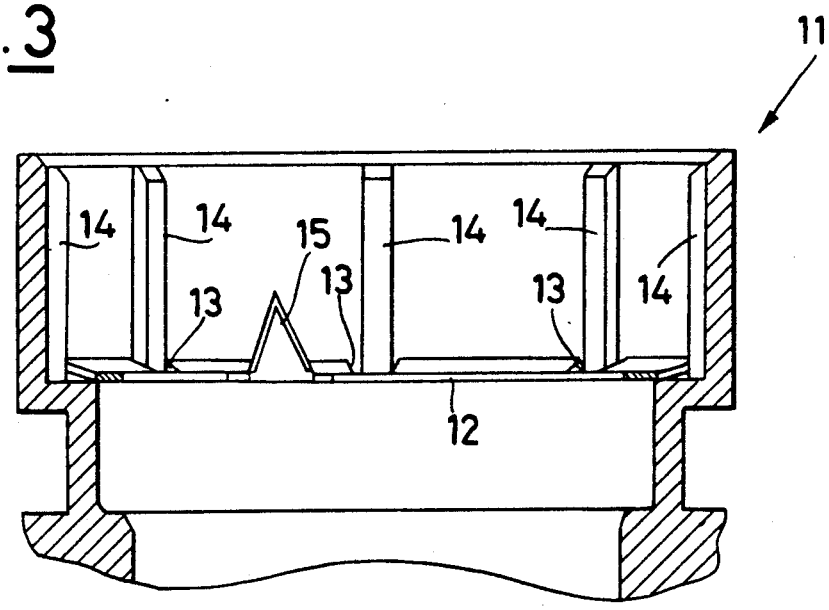

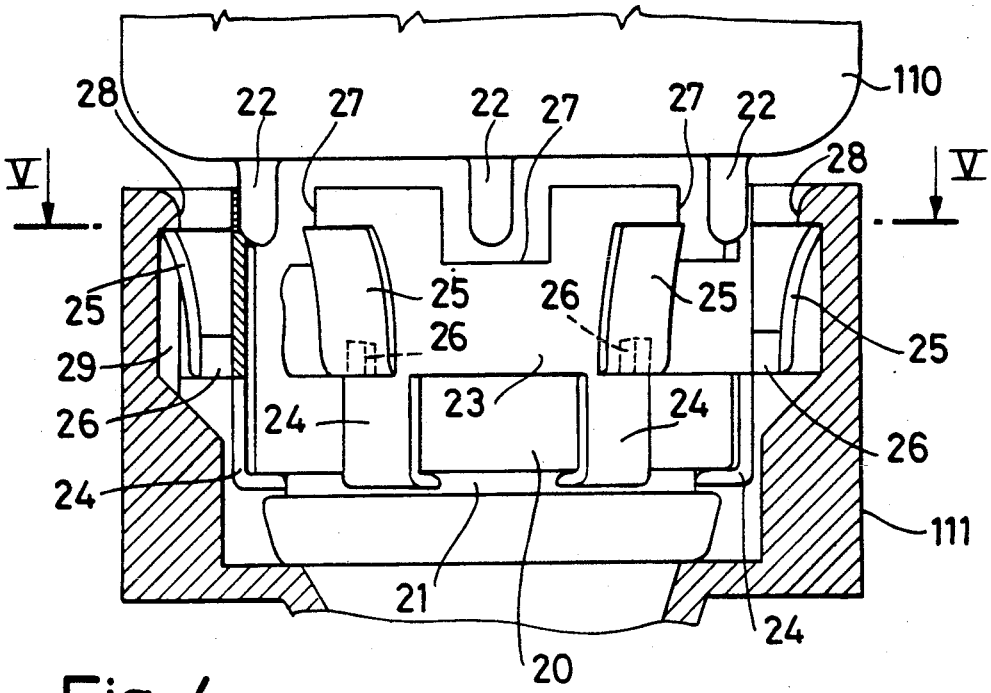
Fig. 4
Fig. 5
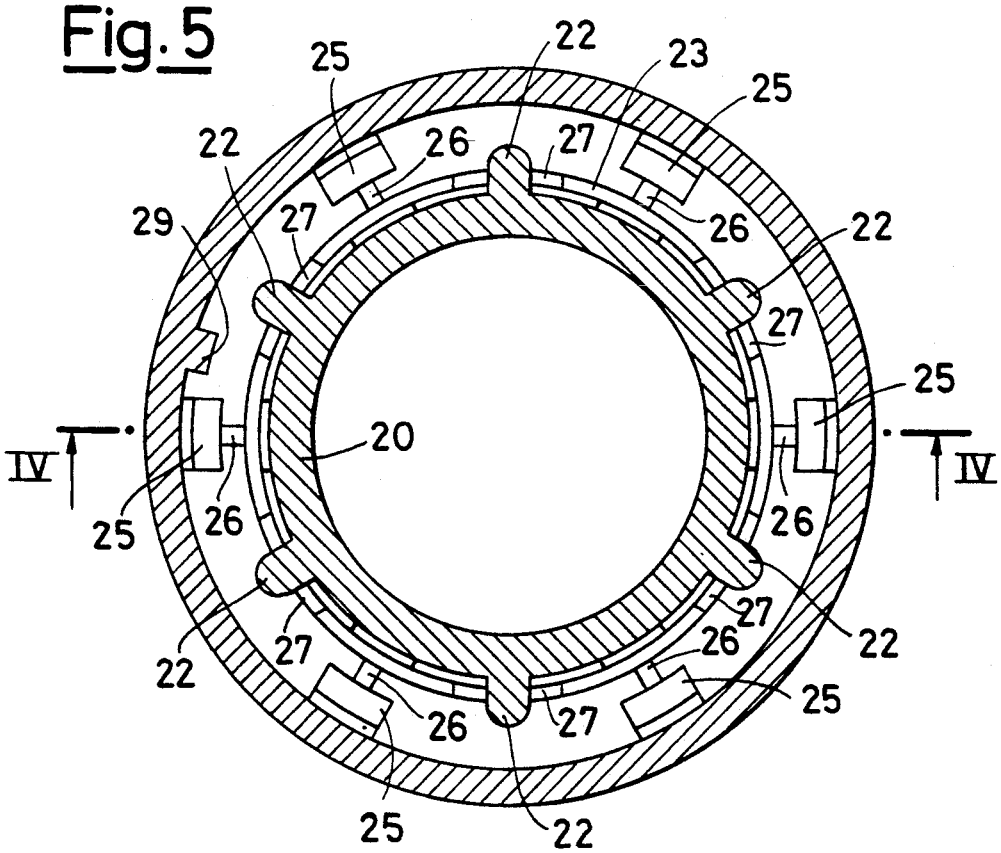

TANK WITH CONNECTING UNION AND A CUTTING BLADE

There are known machines for automatic preparation and dispensing of beverages made from lyophilized powdered compounds and the like such as for example coin-operated machines for the dispensing of coffee beverage and having a replaceable container containing the soluble powdered compound.

One problem with these machines is that for various reasons the users thereof may decide to replenish the powdered compound without using the original replacement unit but by refilling the old container with a compound from another source. This can lead to a decline in the quality of the beverage and malfunction of the machine if the replacement compound used does not meet the characteristics specified by the machine maker and provided by the compound contained in the original container units.

In addition, in the case of machines for which there has been drawn up a service contract calling for periodic maintenance by skilled personnel performing replenishment of the consumable materials such as discardable cups and spoons, the containers of powdered compound for the various beverages dispensed by the machine, etc., unauthorized filling of the used container also involves financial loss for the company administering the contract.

The general object of the present invention is to obviate the above mentioned shortcomings by supplying a powdered compound tank for beverage dispensing machines consisting of a container and a union for engagement thereof with the machine which would not allow reuse of the container following refilling by unauthorized personnel.

In view of said object there is provided in accordance with the invention a soluble powdered compound tank for the preparation of beverages comprising a container the mouth of which is connected to a union for supply of the compound to an automatic beverage preparation and dispensing machine, said container comprising near its mouth means of engagement in complementary seats in the union characterized in that said engagement means are irreversible and breakable from the container by interference with means of separation in the union upon rotation of the container therein in such a way as to allow separation of the container from the union.

To further clarify the explanation of the innovative principles of the present invention and its advantages as compared with the known art there are described below with the aid of the annexed drawings possible embodiments as examples applying said principles. In the drawings:

FIG. 1 shows a partial cross section of a side elevation of a first embodiment in accordance with the present invention of a tank comprising a container of powdered compound and a union for connection thereof to a machine dispensing beverages made from said compound, FIG. 2 shows a plan view of the union of FIG. 1, FIG. 3 shows a cross section view along plane of cut III—III of FIG. 2, FIG. 4 shows a partial cross section of a side elevation along plane of cut IV—IV of FIG. 5 of a second embodiment in accordance with the invention of a tank comprising a container of powdered compound and a union for connection thereof to a machine dispensing beverages made from said compound, and FIG. 5 shows a cross section along plane of cut V—V of FIG. 4.

With reference to the figures, as shown in FIG. 1 a container 10 made of plastic material, e.g. polyethylene, for containing a lyophilized powdered compound for preparation of beverages such as for example coffee, is connectable to a union 11 for connection of the container to a machine of the known art and therefore not shown, for automatic preparation and dispensing of beverages.

As may be seen in FIGS. 2 and 3 the union has in the receiving part of the container neck a metallic annular blade 12 having the outer circumferential edge slightly inclined outward toward the exterior of the union so as to be insertable by force in its place, thus preventing its removal. In addition, the edge of the blade 12 has at regular intervals along the circumference notches 13 for receiving ribs 14 placed on the inner wall of the union so as to prevent even rotation in relation to the union. The blade 12 has a part shaped and bent to form a further blade 15 directed toward the opening of the union parallel to the direction of insertion of the container therein.

As may be seen in FIG. 1 the container has near the mouth a virtually flat annular part 16 with surface arranged at a right angle to the axial extension of the container to be cut by the blade 15 upon insertion of the neck of the container in the union.

The terminal part 19 of the container neck has two diametrically opposing projections 17 with tapered form to pass over the tab 12 upon insertion of the container neck in the union so as to prevent removal of the container and thus form irreversible engagements.

Advantageously the container has near the neck a threading 18 for screwing of a cap (not shown) for sealing during transportation and storage.

At the time of use it suffices to engage the container on the connector and press until passage of the projections 17 beyond the tab 12 obtaining engagement with resulting impossibility of removal of the container while the blade 15 cuts through the surface 16. The container thus remains firmly connected to the machine, which can then perform the normal operative cycles taking in accordance with the known art the measures of powder from the container. When the container is empty it suffices to rotate it around its own axis so that the blade 15 cuts circularly the surface 16 separating the part 19 from the rest of the container which is thus freed from the union. The part 19 is reduced virtually to a simple ring and can subsequently be withdrawn by deforming it slightly to allow passage of the projections through the tab. Said deformation was previously prevented by the unbroken nature of the part 19 at the surface 16 which stiffened it.

FIGS. 4 and 5 show a second possible embodiment applying the innovative principles claimed herein to connect a container 110 to a union 111.

The container 110, which may be advantageously made of glass, has a neck 20 with a circumferential groove 21 near the end and ribs 22 near the base.

A ring element 23 made of plastic material is fitted on the neck 20 and comprises tongues 24 for engagement in the groove 21, tabs 25 bent outward and connected to the ring 23 by segments 26, and recesses 27 for receiving the ribs 22.

Upon insertion of the neck 20 bearing the ring 23 in the union 111 the tabs 25 engage under one edge 28 at the open end of the union preventing its removal by forming irreversible engagements. In addition the free edge of the neck butts against a ledge 28 in the union. The container 110 is thus firmly secured to the union.

To separate the container it suffices to rotate it around its own axis so that the ring element also rotates in the union entrained by the engagement of the ribs 22 in the recesses 27.

Inside the union there is a rib 29 projecting inward which, when the ring rotates, meets one at a time the tabs 25 and bends them to one side, breaking the supporting segments 26 and thus allowing removal of the neck 20 with the ring 23 from the union 111.

It may advantageously be sought to use the groove 21 for fixing a closing cap of the container during handling and storage and supply separately the ring 23 to be fitted on the container neck after removal of the closing cap immediately before insertion of the neck in the union. One advantage of using this second embodiment of a glass container is also to have the possibility, when withdrawing the empty containers, to reuse them by refilling them and coupling them with a new ring 23 while preventing reuse thereof to a person without a ring 23 coupled with containers.

It is now clear how, thanks to the innovative principles claimed herein, it is possible to achieve the objects of preventing uncontrolled reuse of containers of powdered products for the preparation of beverages in automatic dispensing machines.

Although the invention has been described for a specific embodiment it is evident that many alternatives and variations, such as in materials and dimensions, will be apparent to those skilled in the art in light of the foregoing description. Accordingly, the invention is intended to embrace all of the alternatives and variations that fall within the spirit and scope of the invention. For example, the ring 23 can be made as an integral part of a one-use plastic container to be discarded after separation from the union or a neck similar to the neck 19 and comprising a cutting zone 16 can be fixed to a container made, for example, of glass.

I claim:

1. A tank for a soluble powder compound used for preparation of beverages, comprising a container having thereon an integral annular neck portion defining in one end thereof a mouth, means for connecting said neck to the bore in a union for feeding of the compound from said container and through said union to a machine for automatic preparation and dispensing of beverages, said connecting means including detent means irreversibly latched to a complementary recess in said union thereby to secure said container in operative relation to said machine, and destructible detent supporting means extending between said detent means and said neck transversely of the axis of said neck, and characterized in that said union further includes at least one severing element fixed in said union and operative upon axial insertion of said neck into said union to extend axially of said neck and transversely into the path of said detent supporting means, said severing element being operable upon rotation of said container relative to said union to effect the separation of said detent supporting means from said container, thereby allowing separation of the container from the union.

2. A tank for a soluble powder compound for preparation of beverages comprising a container having an annular neck surrounding the outlet of the container, said neck having intermediate its ends a circumferential portion extending transverse to the axis of said neck, and having on a terminal portion thereof engagement means for connecting said neck to a union for feeding of the compound to a machine for automatic preparation and dispensing of beverages, said union comprising cutting means for cutting said transverse portion of the neck thereby to separate said terminal portion from the neck upon rotation of the container in one direction around the neck axis, characterized in that the engagement means comprise at least one snap element disposed irreversibly to engage in a complementary seat in the union by axial insertion of the neck into the union, and said cutting means comprising at least one fixed blade which penetrates through said transverse portion of the neck upon engagement of the container in the union, said blade having a cutting edge disposed to face in the direction opposite to said one direction.

3. A tank in accordance with claim 2 characterized in that the neck is a separate element connected to the container.

4. A tank in accordance with claim 2 characterized in that said cutting blade is pressed and formed from a metal ring which is positioned around the inner circumference of said union.

5. A tank in accordance with claim 4, characterized in that said metallic ring constitutes said complementary seat for said snap element.

6. A tank in accordance with claim 2 characterized in that said snap element comprises one of a plurality of radial projections extending from said terminal portion of said neck.

7. A tank in accordance with claim 6 characterized in that said radial projections are provided in the form of teeth tapered in the direction of engagement of the container with the union.

8. A tank in accordance with claim 2 characterized in that said neck and container are formed from a single piece of plastic material.

* * * * *

UNITED STATES PATENT OFFICE

CERTIFICATE OF CORRECTION

Patent No. 5,152,428 Dated Oct. 6, 1992

Inventor(s) Silvestro Di Girolamo

It is certified that error appears in the above-identified patent and that said Letters Patent is hereby corrected as shown below:

On the title page, Item [76] Inventors Last Name:

"Di Gerolamo" should be --Di Girolamo--.

Signed and Sealed this

Twelfth Day of October, 1993

*Attest:*

*Attesting Officer*

BRUCE LEHMAN

*Commissioner of Patents and Trademarks*